US009440479B2

(12) United States Patent
Ishikawa et al.

(10) Patent No.: US 9,440,479 B2
(45) Date of Patent: Sep. 13, 2016

(54) BOOKBINDING WITH CUTTING AND RE-ATTACHING SHEETS

(71) Applicant: CANON KABUSHIKI KAISHA, Tokyo (JP)

(72) Inventors: Masashi Ishikawa, Chofu (JP); Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 14/192,486

(22) Filed: Feb. 27, 2014

(65) Prior Publication Data

US 2014/0308093 A1 Oct. 16, 2014

(30) Foreign Application Priority Data

Apr. 10, 2013 (JP) ..... 2013-082420

(51) Int. Cl.

| | |
|---|---|
| ***B42C 19/00*** | (2006.01) |
| ***B42C 9/00*** | (2006.01) |
| ***B42C 5/00*** | (2006.01) |
| ***B42C 11/00*** | (2006.01) |
| ***B42C 19/02*** | (2006.01) |
| ***B42D 1/00*** | (2006.01) |

(52) U.S. Cl.

CPC ..... *B42C 9/0056* (2013.01); *B42C 5/00* (2013.01); *B42C 11/00* (2013.01); *B42C 19/02* (2013.01); *B42D 1/002* (2013.01); *B42D 1/008* (2013.01)

(58) Field of Classification Search

CPC ..... B42C 19/00; B42C 19/02; B42C 19/04; B42D 1/08; B42D 1/10

USPC ..... 270/52.17, 58.07; 83/934

See application file for complete search history.

(56) References Cited

U.S. PATENT DOCUMENTS

| | | | | | |
|---|---|---|---|---|---|
| 3,620,882 | A * | 11/1971 | Chou | B31F 5/085 | 156/202 |
| 3,939,513 | A * | 2/1976 | Crathern, III | B42B 5/00 | 412/1 |
| 4,986,864 | A * | 1/1991 | Heim | B29C 63/0039 | 156/201 |
| 5,941,569 | A * | 8/1999 | Solomons | B42D 1/08 | 281/15.1 |
| 6,153,047 | A * | 11/2000 | Gunasekera | B42F 5/00 | 156/461 |
| 7,014,182 | B2 * | 3/2006 | Marsh | B26D 5/02 | 270/1.01 |
| 7,437,994 | B1 * | 10/2008 | Ratzloff | B42F 5/00 | 101/483 |
| 7,661,715 | B2 * | 2/2010 | Porat | B42B 5/08 | 281/21.1 |
| 8,167,293 | B2 * | 5/2012 | Lewalski | B26D 7/0641 | 270/52.17 |
| 8,668,228 | B2 * | 3/2014 | Holmberg | B42D 13/00 | 281/38 |
| 2005/0230957 | A1 | 10/2005 | Holmberg | | |
| 2006/0245804 | A1 * | 11/2006 | Yamamoto | B42C 3/00 | 400/62 |
| 2009/0252574 | A1 | 10/2009 | Ratzloff | | |
| 2010/0007071 | A1 | 1/2010 | Hayashi | | |

FOREIGN PATENT DOCUMENTS

| | | | | |
|---|---|---|---|---|
| CH | 638139 | A5 | | 9/1983 |
| CN | 2262491 | Y | | 9/1997 |
| CN | 201745272 | U | | 2/2011 |
| CN | 202038025 | U | | 11/2011 |
| CN | 203792933 | U | | 8/2014 |
| JP | 09123636 | A | * | 5/1997 |
| JP | H09-123636 | A | | 5/1997 |
| JP | H11-147654 | A | | 6/1999 |

* cited by examiner

*Primary Examiner* — Patrick Mackey

(74) *Attorney, Agent, or Firm* — Canon U.S.A., Inc. IP Division

(57) ABSTRACT

A sheet processing apparatus includes a processing table to which a printed sheet is transported, a positioning member that positions the sheet, a cutter that cuts the positioned sheet into a binding margin portion and an image portion, and a taping unit that joins the binding margin portion and the image portion together with a tape in a state in which a gap is formed therebetween.

14 Claims, 16 Drawing Sheets

BOOKBINDING WITH CUTTING AND RE-ATTACHING SHEETS

BACKGROUND

1. Field

Aspects of the present invention generally relate to a sheet processing apparatus for making a photo album or a photo book by binding printed sheets.

2. Description of the Related Art

Japanese Patent Laid-Open No. 9-123636 describes a method of making a photo album by binding printed sheets. In this method, a printed sheet and a small piece of sheet, which is used as a binding margin, are prepared; and a sheet is made by joining the printed sheet and the small piece together by affixing laminate films from both sides in a state in which a gap is formed between the printed sheet and the small piece. A photo album is made by fastening the binding margins of such sheets together. A viewer can easily turn a page of the photo album because a part of the laminate films at the gap, which is at the center of double-spread pages, serves as a flexible hinge.

In the method described in Japanese Patent Laid-Open No. 9-123636, first, upper and lower portions of the small piece and the printed sheet are fixed to each other by using auxiliary sheets, such adhesive tapes, so as to form an appropriate gap between the small piece and the printed sheet. This operation is manually performed by an operator. The operator's power of concentration decreases as the number of sheets increases, and it becomes more likely that quality deviation occurs.

The term "quality deviation" refers to nonuniformity in the dimensions of the gap and nonuniformity in the parallelism between the edges of the gap. FIG. 16A illustrates an example in which a small piece and a printed sheet are fixed to each other by using an adhesive tape in a state in which the printed sheet is inclined relative to the small piece, a portion of a finished sheet that serves as a hinge, which is made by cutting this sheet, has a wedge shape illustrated in FIG. 16B, instead of a parallel shape (a rectangular shape having a constant width). If a photo album is made by binding such sheets, the right page does not have an accurately rectangular shape when the photo album is opened as illustrated in FIG. 16C. Moreover, an upper portion of the hinge on the right page is exposed to the outside to a larger degree than a lower portion of the hinge (as shown by hatching in FIG. 16C). Such poor finish is not pleasing to a viewer's eye, and the appearance of the photo album is impaired. In addition, because such wedge-shaped hinges do not bend uniformly when a viewer turns pages, the viewer feels an unpleasant sensation when turning the pages. Even in a case where the gap does not have a wedge shape but has a parallel shape, the widths of the hinges are not uniform if the dimensions of the gaps differ between the pages, and, also in this case, the finish of the photo album is poor.

SUMMARY

Aspects of the present invention are generally directed to provide a sheet processing apparatus that can perform high-quality bookbinding without causing quality deviation and that is suitable for mass production.

According to an aspect of the present invention, a sheet processing apparatus that processes a printed sheet for bookbinding includes a table on which a sheet is placed when processing the sheet, a positioning member that positions the sheet placed on the table, a cutter that cuts the sheet positioned by the positioning member into a binding margin portion and an image portion, and a taping unit that joins the binding margin portion and the image portion together with a tape in a state in which a gap is formed between the binding margin portion and the image portion.

Further features of the present disclosure will become apparent from the following description of exemplary embodiments with reference to the attached drawings.

DESCRIPTION OF THE EMBODIMENTS

A sheet processing apparatus according to an exemplary embodiment will be described. The sheet processing apparatus is used to form a flexible hinge in each of printed sheets, on which a printer has formed images (of photographs, figures, and characters), when the printed sheets are bound together to form a booklet such as a photo album or a photo book.

Figure 1A:
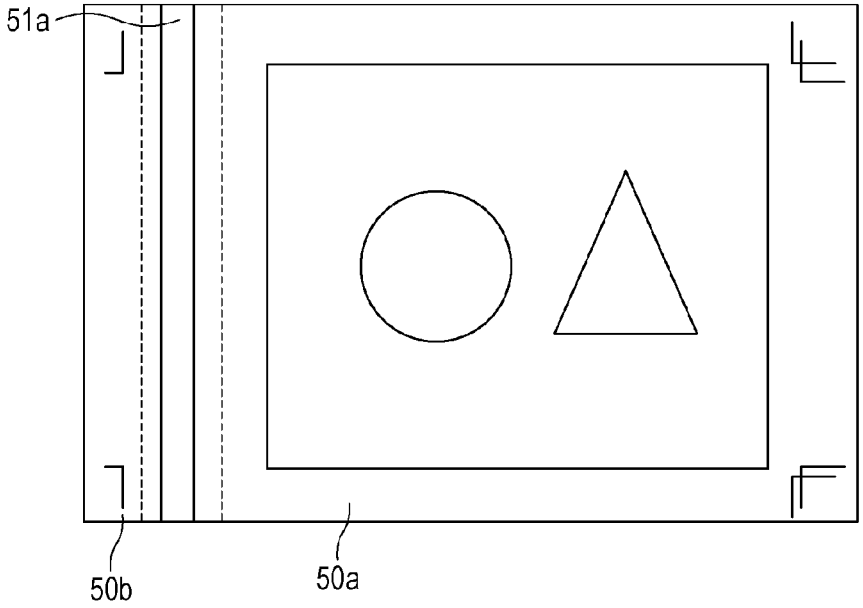
FIGS. 1A is a conceptual diagram for illustrating steps of processing a printed sheet, and FIGS. 1B and 1C each illustrate a portion of a finished booklet in which printed sheets are bound together.

FIG. 1A is a conceptual diagram for illustrating steps of processing a printed sheet. First, the printed sheet is cut into an image portion 50*a*, on which an image has been printed, and a binding margin portion 50*b*, which serves as a binding margin when a plurality of such printed sheets are bound. An image is printed on the sheet beforehand by using a printer so as to leave a margin. Then, the divided sheets are accurately positioned so that a gap having parallel edges and having appropriate dimensions is formed between the image portion 50*a* and the binding margin portion 50*b*. Transparent adhesive tapes 51*a* are affixed from both sides of the divided sheets so as to cover the gap. Thus, a flexible hinge made from the adhesive tapes 51*a* is formed between the image portion 50*a* and the binding margin portion 50*b*. As described below, these steps are performed by using an automated apparatus instead of a manual operation.

Figure 1B:
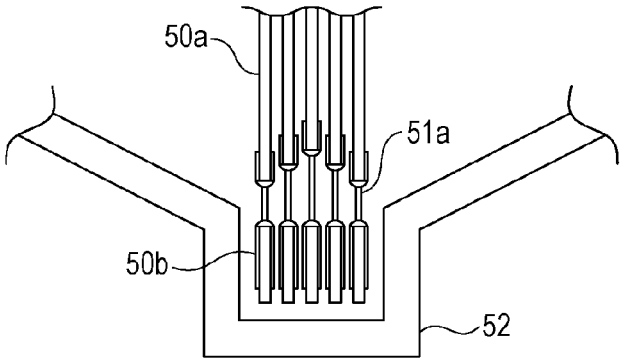
Figure 1C:
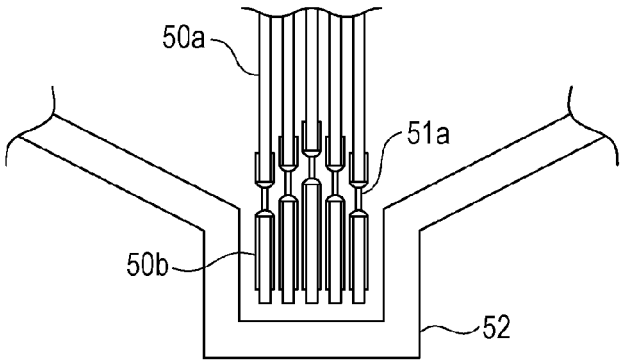

FIGS. 1B and 1C illustrate a portion of a finished booklet in which printed sheets are bound together. The binding margin portions 50*b* of the sheets are fastened together inside of a cover 52 by using a known method, such as stitching, stapling, or bonding. In this example, only five sheets are illustrated to simplify the following description. In practice, however, a larger number of sheets may be bound. The sheets can be opened as the hinges, each of which is made from the flexible adhesive tapes 51*a*, can be bent. Because the hinges, which are made from adhesive tapes, are more flexible than the sheets, the left and right pages can be opened to be flat with an angle of 180° therebetween. This is called lay-flat binding.

In FIG. 1B, the dimensions of the gaps between the image portions and the binding margin portions in the direction in which these portions are separated from each other, that is, the lengths of the hinges are not uniform. The closer a position of a hinge to the center of the bound sheets, the larger the length of the hinge. In other words, in a sectional view, the lower ends of the image portions form a gently convex curve having a peak at the center of the sheet stack. The upper ends of the binding margin portions form a substantially straight line over the entire width of the sheet stack. FIG. 1C illustrates a modification of the booklet shown in FIG. 1B. In a sectional view, the lower ends of the image portions form a gently convex curve having a peak at the center of the sheet stack, as in the case of FIG. 1B. In this case, however, the lengths of the binding margin portions differ from each other so that the upper ends of the binding margin portions form a similar convex curve. The lengths of the hinges are the same for all sheets. In these examples, the dimensions of the gaps may be changed in accordance with at least one of the following parameters: the number of sheets to be bound; the total thickness of the sheets in a direction in which the sheets are stacked; and the thickness of one of the sheets. The dimensions of the gaps are increased as the number of sheets to be bound increases, the total thickness of the sheets increases, and the thickness of one of the sheets increases. By binding the sheets as illustrated in FIG. 1B and 1C, any pages can be opened so as to be flat.

Next, the details of a sheet processing apparatus, which automatically perform the above steps, will be described.

Figure 2:
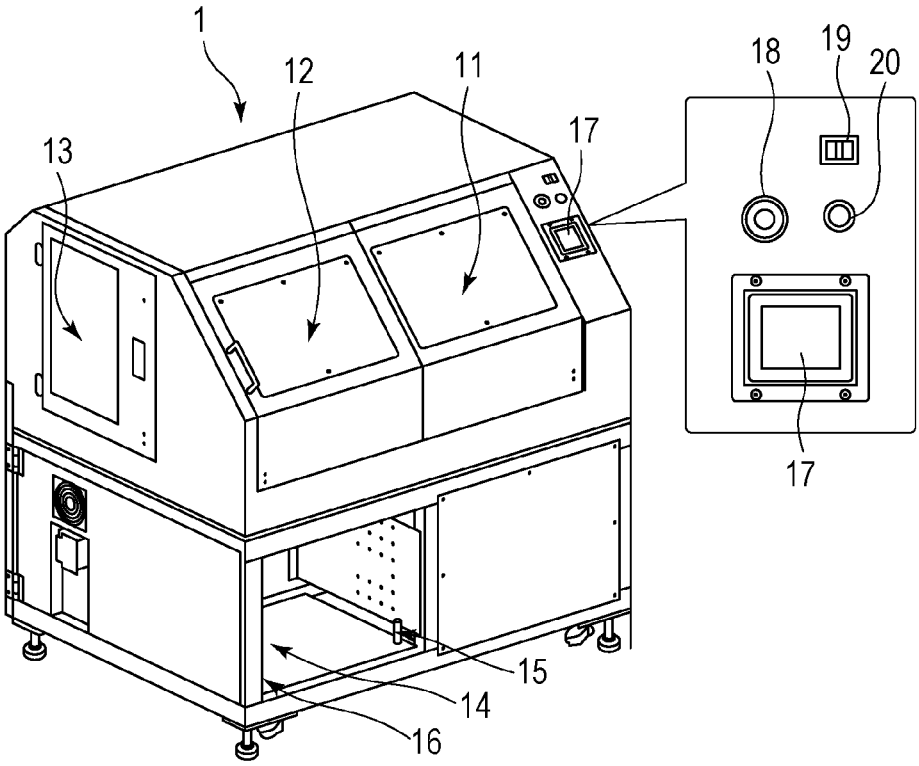
FIG. 2 is an external view of a sheet processing apparatus.

FIG. 2 is an external view of a sheet processing apparatus 1. A first slide door 11 is a door through which an operator supplies printed sheets to be processed. A second slide door 12 is a door through which an operator takes out processed printed sheets. A third door 13 is a door through which an operator supplies an adhesive tape. A container space 14 is a space in which spare parts, such as a spare sheet regulation shaft 15 and a spare cutter unit 16, are stored. A touch panel 17 is a panel with which an operator operates the apparatus. An emergency stop button 18, a switch 19 for a light inside the apparatus, and a recovery button 20 for cancelling an emergency stop mode are disposed near the touch panel 17.

Figure 3:
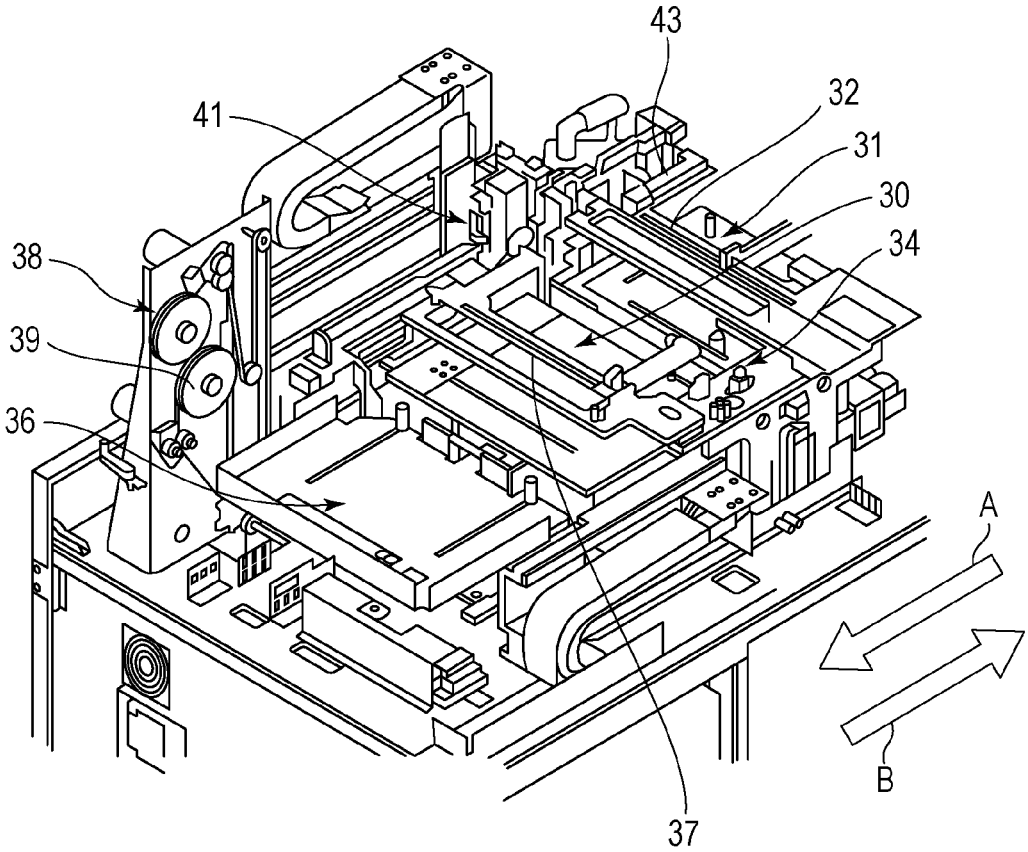
FIG. 3 illustrates the internal structure of the sheet processing apparatus.

FIG. 3 is a perspective view showing the internal structure of the sheet processing apparatus 1. A processing table 30 is a table on which a printed sheet is placed when processing the printed sheet. A supply tray 31 is a tray on which a plurality of printed sheets to be processed are stacked.

A feed arm 32 supports suction pads (suction unit) that hold a printed sheet by suction. The feed arm 32, which includes a mechanism for moving the suction pads up and down, can hold an uppermost one of the stacked printed sheets by suction and lift the sheet. A drive unit 34 causes the feed arm 32 to reciprocate in the directions of arrows A and B. A printed sheet can be transported to the processing table 30 by holding the sheet by suction, lifting the sheet, and moving the feed arm 32 in the direction of arrow A.

A processing unit 41 performs various operations for processing a sheet, such as cutting and taping the sheet. The processing unit 41 includes a cutter that cuts off a binding margin from a printed sheet, a chuck that holds an end of an adhesive tape, a press-bonding roller, a tape cutter that cuts a residual portion of an affixed adhesive tape, and the like. The details of the structure and the operation of the processing unit 41 will be described below. The processing unit 41 is configured to reciprocate during a processing operation.

An output tray 36 is a tray on which processed printed sheets are stacked. An output arm 37 supports suction pads that hold a sheet by suction. The output arm 37, which includes a mechanism for moving the suction pads up and down, can lift the suction pads that hold a printed sheet by suction. The drive unit 34 causes the output arm 37, which is integrated with the feed arm 32, to reciprocate in the directions of arrows A and B. A processed sheet can be transported to the output tray 36 by holding the sheet by suction, lifting the sheet from the processing table 30, and moving the output arm 37 in the direction of arrow A.

A first tape feeding portion 38 rotatably supports a roll of first adhesive tape. A second tape feeding portion 39 rotatably supports a roll of second adhesive tape. The first adhesive tape is affixed to a front surface (first surface) of a sheet. The second adhesive tape is affixed to a back surface (second surface) of the sheet. A pressing plate 43 is disposed on the feed arm 32. When the feed arm 32 is positioned above the processing table 30, the pressing plate 43 presses an end portion of a sheet against the processing table 30 from above. As a result, the sheet is made to extend along a flat surface of the table, and thereby curl of the sheet is removed.

Figure 13A:
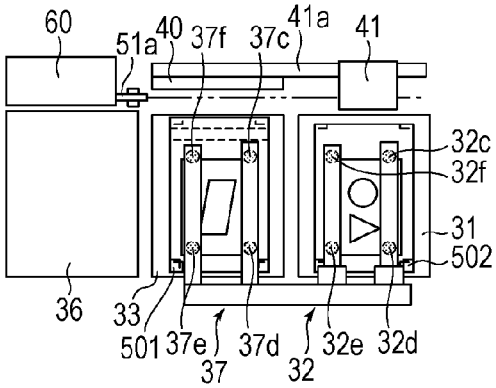
FIGS. 13A to 13E illustrate an operation of feeding a sheet and an operation of outputting a sheet that are simultaneously performed.

FIGS. 13A to 13E are schematic top views of the structure shown in FIG. 3. In FIG. 13A, the supply tray 31, the processing table 30 (a first stage 33 and a second stage 40), and the output tray 36 are arranged side by side. A tape feeder 60 supplies two adhesive tapes. A guide 41*a* guides movement of the processing unit 41 in the left-right direction. The feed arm 32 supports four suction pads 32*c*, 32*d*, 32*e*, and 32*f* (suction unit). The output arm 37 supports four suction pads 37*c*, 37*d*, 37*e*, and 37*f* (suction unit). The drive unit 34 moves the feed arm 32 and the output arm 37 together.

The feed arm 32, the output arm 37, and the drive unit 34 constitute a sheet transporter. The sheet transporter transports sheets that are stacked on the supply tray 31 one by one to the processing table 30. The sheet transporter also transports the sheets from the processing table 30 to the output tray 36.

Figure 4:
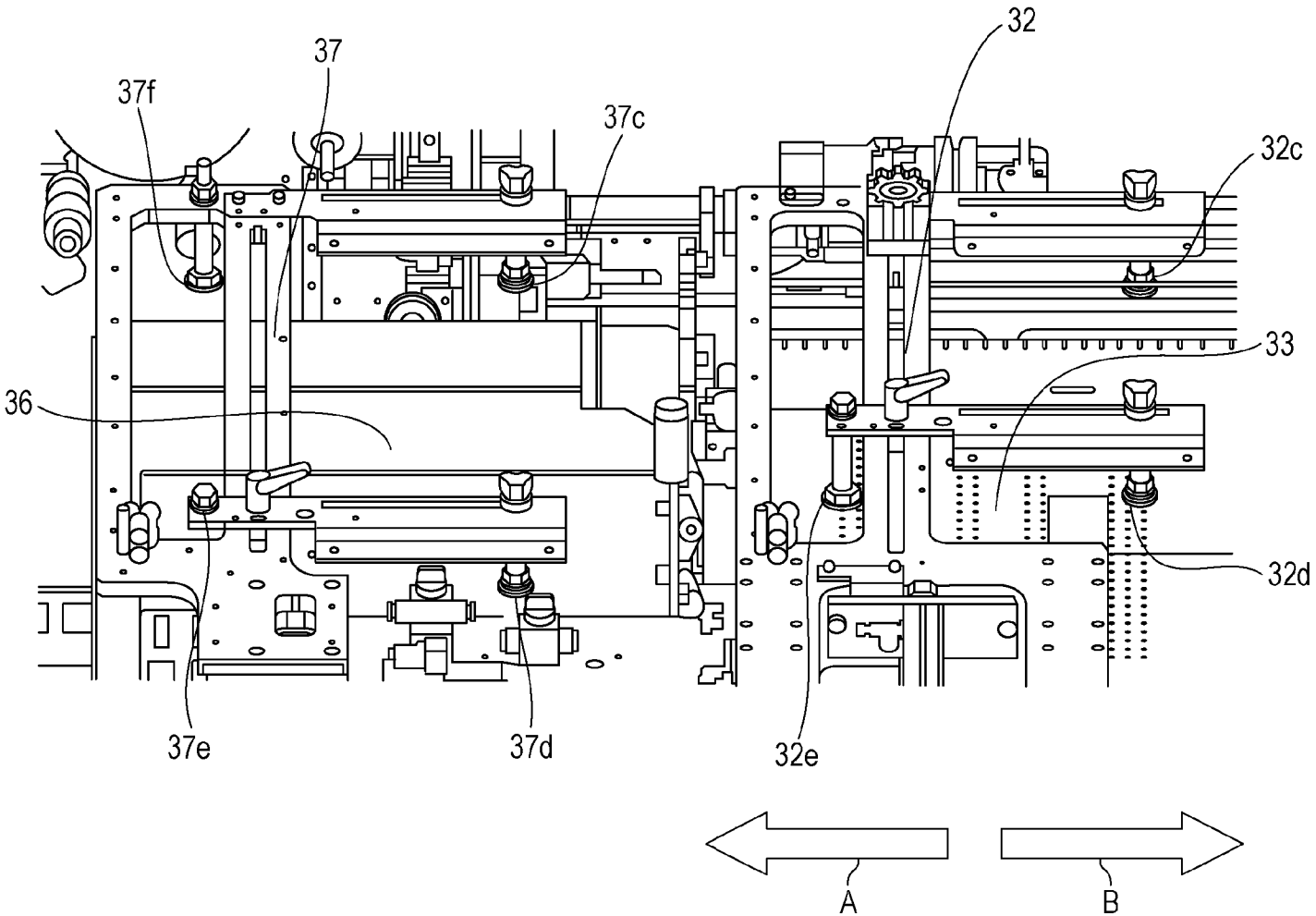
FIG. 4 illustrates the structure of a sheet transporter.

FIG. 4 illustrates the detailed structure of the sheet transporter. The feed arm 32, which is used to supply a sheet, includes sub-arms and suction pads. The feed arm 32 moves in the directions of arrows A and B. The feed arm 32 supports the suction pads 32*c*, 32*d*, 32*e* and 32*f* (not shown). The suction pads 32*c*, 32*d*, 32*e* and 32*f*, which are connected to a negative pressure source through tubes, holds a surface of a printed sheet by suction. The positions of the suction pads can be adjusted in accordance with the size of a printed sheet to be held by suction.

The output arm 37, which is used to output a sheet, includes sub-arms and suction pads. The output arm 37 moves with the feed arm 32 in the directions of arrow A and B. The output arm 37 supports the suction pad 37*c*, 37*d*, 37*e* and 37*f*. The suction pads 37*c*, 37*d*, 37*e* and 37*f*, which are connected to a negative pressure source through tubes, hold a surface of a printed sheet by suction. The positions of the suction pads can be adjusted in accordance with the size of a printed sheet to be held by suction.

Figure 5A:
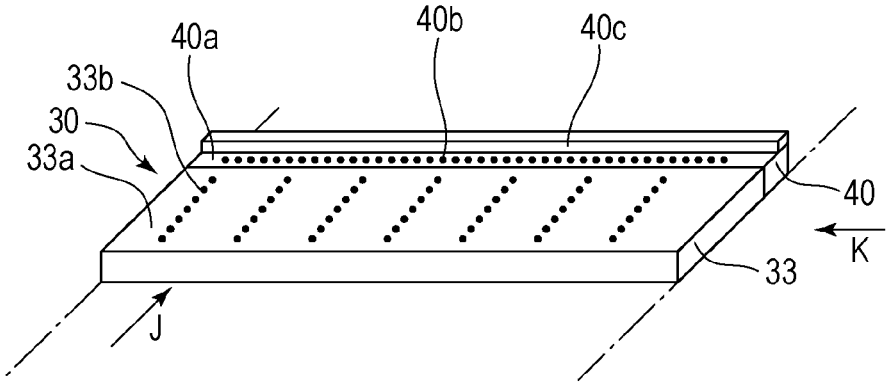
FIGS. 5A and 5B illustrate the positional relationship between a first stage and a second stage.
Figure 5B:
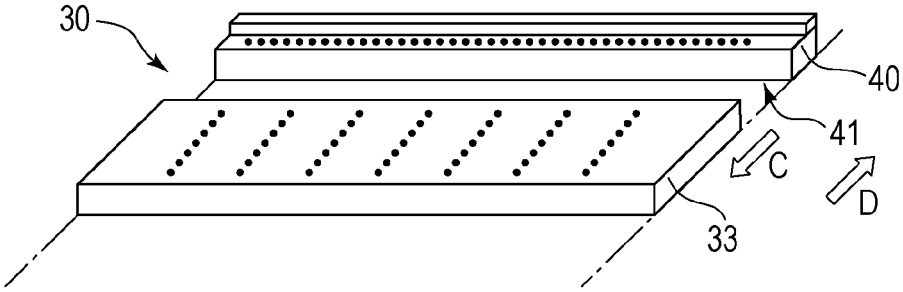

FIGS. 5A and 5B illustrate the details of the processing table 30. The processing table 30 includes the first stage 33 and the second stage 40, which are independent from each other. The first stage 33 holds an image portion of a sheet by suction on a holding surface 33*a* thereof. The second stage 40 holds a binding margin portion of the sheet by suction on a holding surface 40*a* thereof. The positional relationship between the first stage 33 and the second stage 40 can be changed with respect to a direction (indicated by arrow J) perpendicular to a direction in which a cutter cuts a sheet. In the present embodiment, the distance between the first stage 33 and the second stage 40 can be changed, because each of the first stage 33 and the second stage 40 includes a mechanism that moves the stage in directions of arrows C and D. Alternatively, the first stage 33 may be fixed in place and only the second stage 40 may be configured to be movable.

The inside of the first stage 33 is a negative pressure chamber that is connected to a negative pressure source. A plurality of holes 33*b* are formed in the holding surface 33*a* so as to be connected to the negative pressure chamber. A printed sheet is held by sucking air through the holes 33*b*. Likewise, the inside of the second stage 40 is a negative pressure chamber that is connected to a negative pressure source. A plurality of holes 40*b* are formed in the holding surface 40*a* so as to be connected to the negative pressure chamber. A printed sheet is held by sucking air through the holes 40*b*.

The second stage 40 has a positioning surface 40*c* that contacts an edge of a printed sheet placed on the processing table 30 and that adjusts the position (aligns the inclination) of the printed sheet. The positioning surface 40*c* extends along a plane that is parallel to a direction (indicated by arrow K) in which the cutter cuts a sheet. The second stage 40 is moved in a direction opposite to the direction of arrow J so that an edge of the bending margin portion of a sheet placed on the processing table 30 contacts the positioning surface 40*c* and so that the cutter presses the sheet in a direction (of arrow J) perpendicular to the direction in which the cutter cuts the sheet. Thus, the position of the sheet is adjusted so that the edge of the sheet is oriented in the direction (of arrow K) in which the cutter cuts the sheet.

FIG. 5A illustrates a state in which the first stage 33 and the second stage 40 are in contact with each other. In this state, the holding surface 33*a* of the first stage 33 (for holding a sheet) and the holding surface 40*a* of the second stage 40 (for holding the binding margin portion of the sheet) are connected to each other and form a flat surface. FIG. 5B illustrates a state in which the first stage 33 and the second stage 40 are separated from each other.

The positional relationship between these two stages is set so as to be suitable for each of steps of positioning a sheet, cutting the sheet with a cutter, adjusting a gap between cut sheet portions, and affixing tapes by using a press-bonding roller. The details of these steps will be described below.

Figure 6:
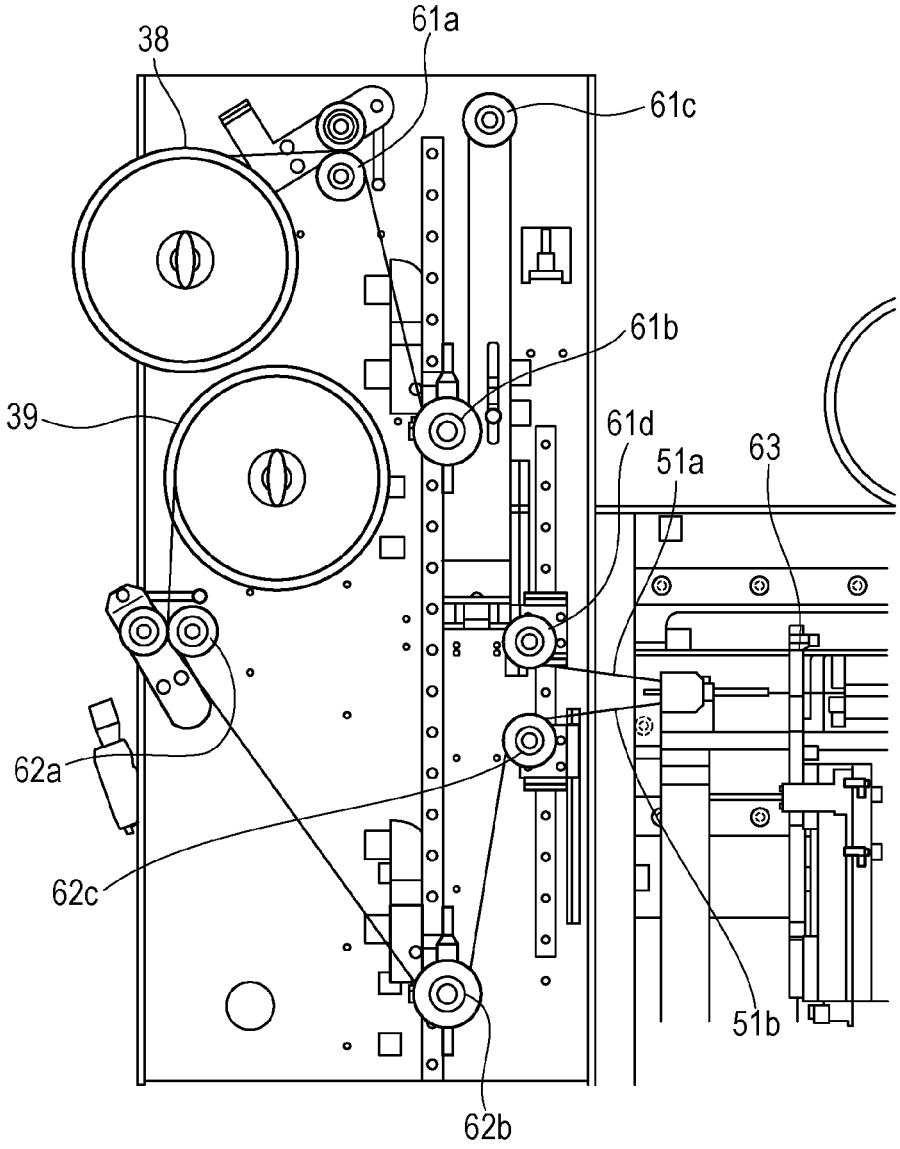
FIG. 6 illustrates the structure of a tape feeder.

FIG. 6 illustrates the internal structure of the tape feeder 60 included in a taping unit. The first tape feeding portion 38, which is disposed in an upper part of the tape feeder 60, supplies an adhesive tape. Guide rollers 61*a*, 61*b*, 61*c*, and 61*d* guide the tape to the processing table 30. The second tape feeding portion 39, which is disposed in a lower part of the tape feeder 60, supplies an adhesive tape. Guide rollers 62*a*, 62*b*, and 62*c* guide the tape to the processing table 30. A movable chuck 63 clamps end portions of the upper and lower adhesive tapes in a state in which adhesive surfaces of the tapes face each other. The tape feeder 60 and the processing unit 41 constitute the taping unit.

Figure 7:
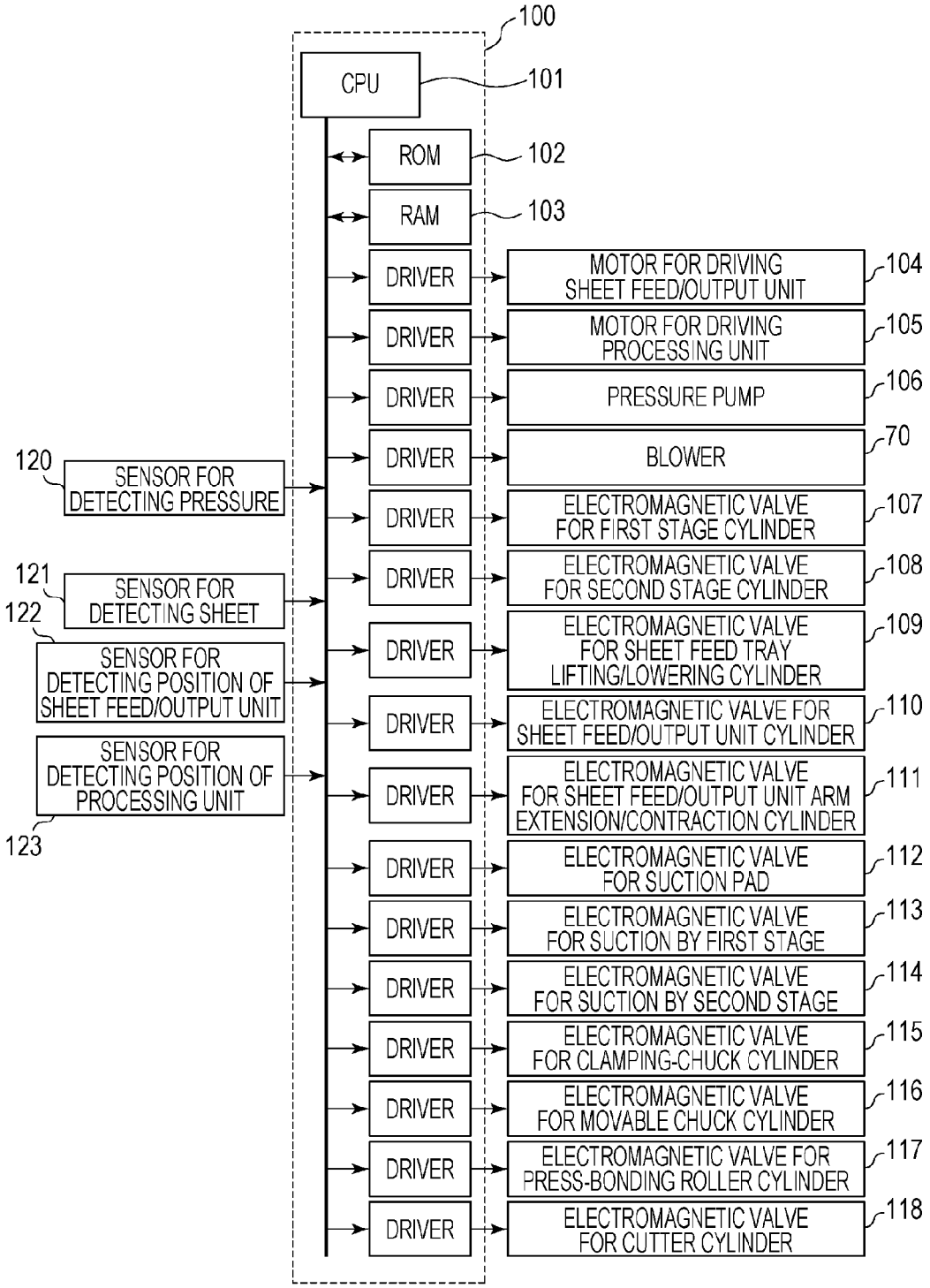
FIG. 7 is a system block diagram of the sheet processing apparatus.

FIG. 7 is a system block diagram of the sheet processing apparatus as a control system. A controller 100 includes a CPU 101 that performs control and calculation; a ROM 102 that stores programs, constants, and numerical data tables; and a RAM 103 that stores temporary data. The controller 100 further includes drivers for driving motors, pumps, and electromagnetic valves.

Control objects, such as motors, pumps, electromagnetic valves, are connected to the controller 100. A motor 104 is a driving source that moves the feed arm 32 and the output arm 37. A motor 105 is a driving source that causes the processing unit 41 to reciprocate along the guide 41*a*. A pressure pump 106 is used to store high-pressure compressed air for driving cylinders into a high pressure tank and to store negative pressure air to serve as a negative pressure source for holding a sheet by suction. A blower 70 blows air to separate sheets from each other.

Electromagnetic valves 107 and 108 are used to control supply of compressed air to a cylinder for moving the first stage 33 and a cylinder for moving the second stage 40. Electromagnetic valves 109, 110, and 111 are respectively used to control supply of compressed air to a cylinder for lifting/lowering the supply tray 31, a cylinder for lifting/lowering the feed arm 32 and the output arm 37, and a cylinder for extending/contracting the feed arm 32. An electromagnetic valve 112 is used to control negative pressures supplied to the suction pads of the feed arm 32 and the suction pads of the output arm 37. An electromagnetic valve 113 is used to control the negative pressure chamber of the first stage 33. An electromagnetic valve 114 is used to control the negative pressure of the negative pressure chamber of the second stage 40. An electromagnetic valve 115 is a valve of a cylinder that causes a first chuck 63*a* and a second chuck 63*b* to clamp an object. An electromagnetic valve 116 is a valve of a cylinder that causes the movable chuck 63 to clamp an object. An electromagnetic valve 117 is used to control a cylinder that moves upper and lower press-bonding rollers 44*a* and 44*b*. An electromagnetic valve 118 is used to control a cylinder that moves the cutter for cutting a sheet.

A plurality of sensors 120 detect the pressures inside the high pressure tank and the negative pressure tank. A sensor 121 detects the presence/absence of a sheet and the amount of sheets on each of the supply tray 31, the first stage 33, and the output tray 36. A sensor 122 detects the positions of the feed arm 32 and the output arm 37 in the height direction, the feeding/outputting direction, and the depth direction. A sensor 123 detects the position of the processing unit 41 in a direction in which the processing unit 41 moves.

Next, steps of a process performed by the sheet processing apparatus having the above structure will be described. First, referring to the flowchart of FIG. 8, a process of processing a single printed sheet will be described.

In step S1, the feed arm 32 picks up an uppermost one of unprocessed printed sheets, which have been placed on the supply tray 31 by an operator. In step S2, the sheet transporter transports the printed sheet that has been picked up to the processing table 30. In step S3, the positioning member positions the printed sheet placed on the processing table 30 by correcting the inclination of the sheet. In step S4, the cutter cuts the positioned sheet so as to form a binding margin portion. In step S5, the tape feeder supplies adhesive tapes to the processing table 30. In step S6, the cut portions of the sheet are positioned relative to each other so that a gap formed between the cut portions has predetermined dimensions and parallel edges, that is, so that the gap has a rectangular shape having a constant width. In step S7, the taping unit connects the cut portions by affixing adhesive tapes from both sides of the cut portions of the sheet by pressing the adhesive tapes using the press-bonding roller. In step S8, the affixed adhesive tapes are cut at positions near both ends of the sheet. In step S9, the sheet transporter transports the processed sheet from the processing table 30 to the output tray 36. If there are unprocessed sheets remaining at this time, the next sheet is transported from the supply tray 31 to the processing table 30 simultaneously with outputting the processed sheet to the output tray 36. The operation described above is repeated until all of the printed sheets placed on the supply tray 31 are processed.

Hereinafter, each of these steps will be described further in detail. FIGS. 9A to 9F illustrate how the positional relationship between the two stages change in accordance with the operation performed on the processing table. FIGS. 9A to 9F are sectional views of the first stage 33 and the second stage 40 seen in the direction of arrow K in FIG. 5A.

Figure 9A:
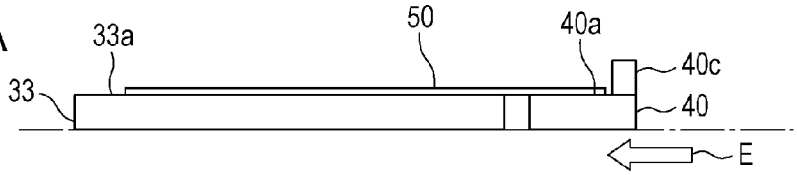
FIGS. 9A to 9F illustrate the positional relationship between the first stage and the second stage.

FIG. 9A shows the positional relationship between the first stage 33 and the second stage 40 when a sheet 50 is supplied from a supply tray 31 and placed on the processing table 30. A small gap is formed between the two stages. A part of the sheet 50 is placed on the holding surface 33*a* of the first stage 33 and the remaining part of the sheet 50 is placed on the holding surface 40*a* of the second stage 40. The sheet 50 is placed so that a small gap is formed between an edge of the sheet 50 and the positioning surface 40*c* of the second stage 40. In this state, neither of the first stage 33 and the second stage 40 applies a suction force due to a negative pressure, and the sheet 50 is just placed on the holding surfaces.

Figure 8:
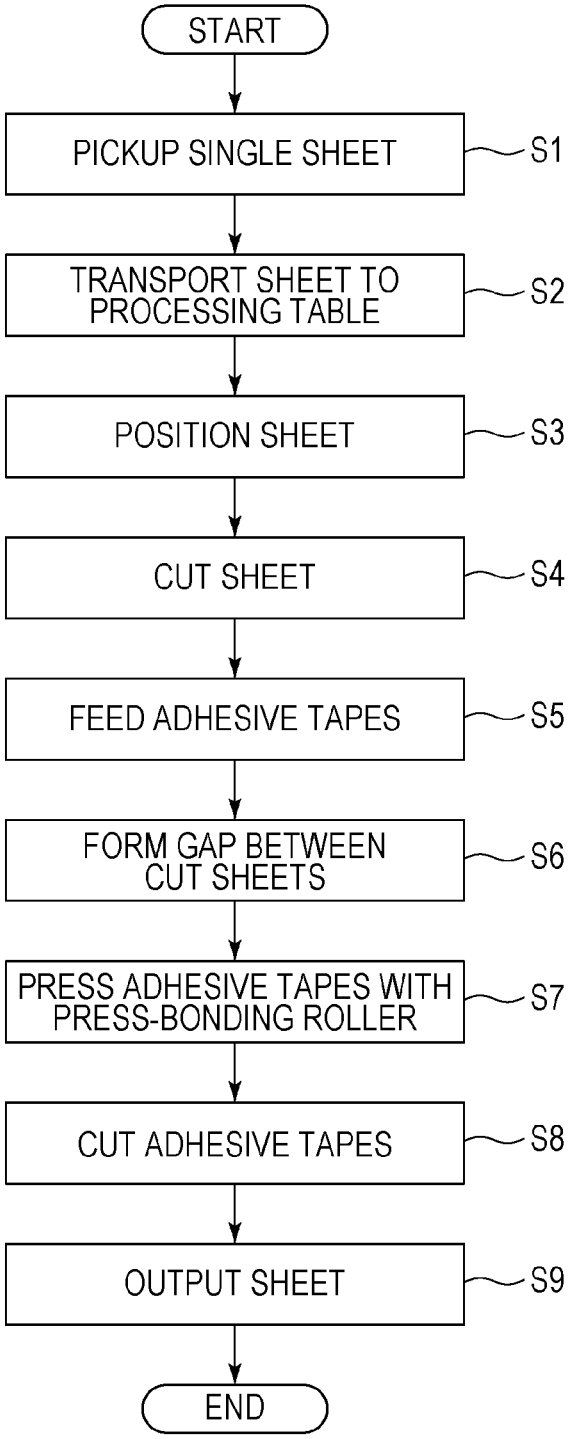
FIG. 8 is a flowchart illustrating a schematic sequence of sheet processing.
Figure 9B:
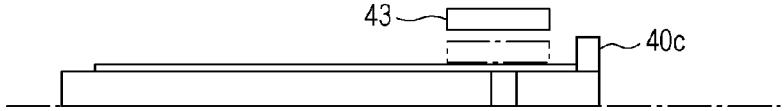

Next, as illustrated in FIG. 9B, the second stage 40 is moved in a direction (direction of arrow E) such that the second stage 40 becomes closer to the first stage 33. The positioning surface 40*c* presses an edge of the sheet 50, so that, even if the sheet 50 has an inclination, the inclination is corrected and the sheet 50 is positioned (step S3 in FIG. 8).

Next, the pressing plate 43 is lowered to a position shown by an alternate long and short dash line in FIG. 9B, and thereby an end portion of the sheet 50 is pressed against the holding surface 33*a* and the holding surface 40*a*. In this state, a negative pressure is applied to the negative pressure chambers of the first stage 33 and the second stage 40, and thereby the sheet 50 is held by suction on the holding surface 33*a* and the holding surface 40*a*. The sheet can be securely held by suction in a short time, because suction is started after removing curl of the sheet by pressing the sheet with the pressing plate 43.

Figure 9C:
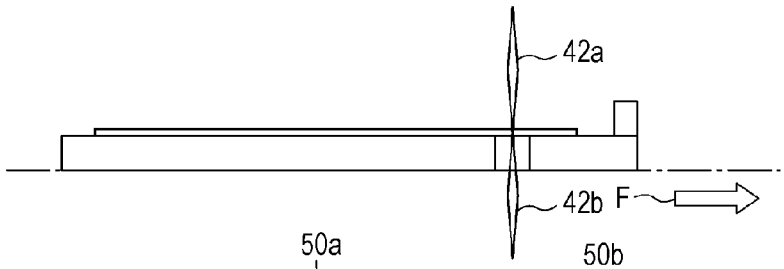

Next, while maintaining the negative pressure in the negative pressure chamber of the first stage 33, only the negative pressure chamber of the second stage 40 is connected to the atmosphere so as to release the negative pressure. As a result, only by the holding surface 33*a* holds the sheet 50 by suction. In this state, while keeping the first stage 33 at rest, the second stage 40 is moved in the direction of arrow F (refer to FIG. 9C). The second stage 40 is stopped when the distance between the first stage 33 and the second stage 40 becomes an appropriate width that is suitable for cutting the sheet with the cutter. Next, a negative pressure is applied to the negative pressure chamber of the first stage 33, so that both of the holding surface 33*a* and the holding surface 40*a* hold the sheet 50 by suction. In this state, as illustrated in FIG. 9C, the sheet is cut by moving an upper round blade 42*a* and a lower round blade 42*b* is a direction perpendicular to the plane of FIG. 9C (step S4 of FIG. 8).

Figure 9D:
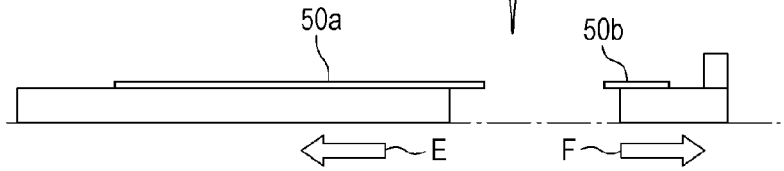

After the sheet has been cut, as illustrated in FIG. 9D, the first stage 33 and the second stage 40 are moved in directions so that they are separated from each other. The first stage 33 is moved in the direction of arrow E by a predetermined distance, and the second stage 40 is moved in the direction of arrow F by a predetermined distance. As a result, a large gap is formed between the image portion 50*a*, which is held on the first stage 33, and the binding margin portion 50*b*, which is held on the second stage 40. This gap serves to prevent interference between the sheet and adhesive tapes when the taping unit supplies the adhesive tapes to the processing table.

Figure 9E:
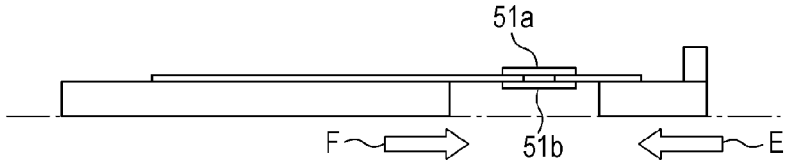

After the tapes have been supplied, as illustrated in FIG. 9E, the first stage 33 is moved in the direction of arrow F and the second stage 40 is moved in the direction of arrow E, so that an appropriate gap is formed between the image portion 50*a* and the binding margin portion 50*b* (step S6 of FIG. 8).

It is necessary to strictly control the dimensions and the parallelism of edges of this gap, because this gap will become a hinge when the sheets are bound and determine the quality of a finished booklet. The sheet does not move and does not become displaced on the stages when the cutter cuts the sheet and when the stage is moved after the sheet has been cut, because the suction units of the first stage 33 and the second stage 40 strongly holds the sheet by suction. Therefore, the gap can be adjusted with a high accuracy.

Figure 9F:
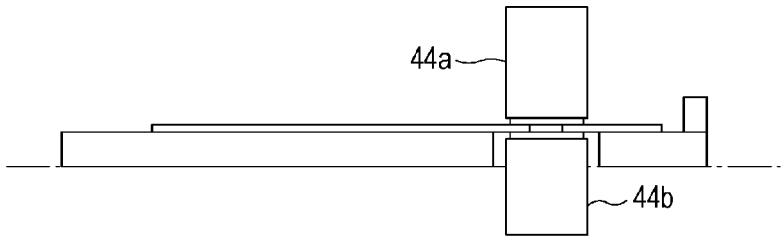

As illustrated in FIG. 9E, in a state in which the gap between cut portions of the sheet is strictly controlled as described above, the adhesive tapes 51*a* and 51*b* are affixed from both sides of the sheet. Then, as illustrated in FIG. 9F, the tapes are strongly bonded to the sheet as the upper and lower press-bonding rollers 44*a* and 44*b* roll along the tapes (step S7 of FIG. 8).

Figure 10A:
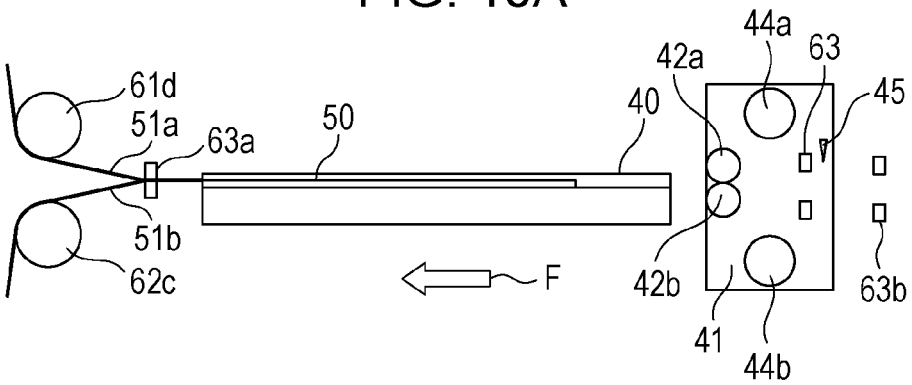
FIGS. 10A to 10C illustrate steps of cutting a sheet with a cutter.
Figure 10B:
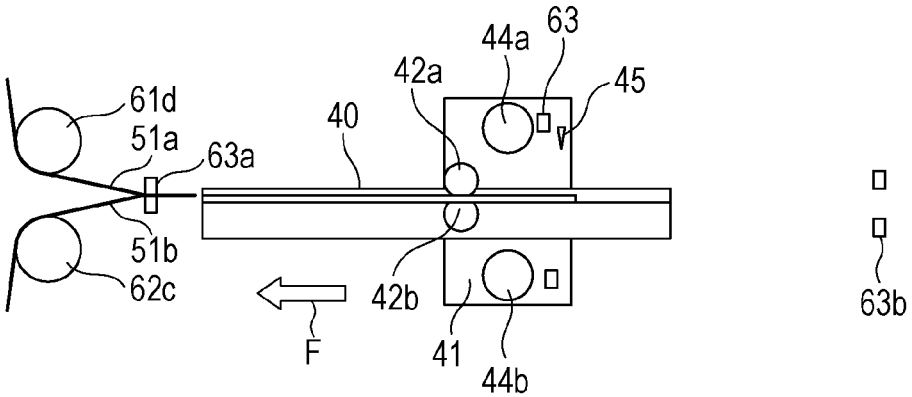
Figure 10C:
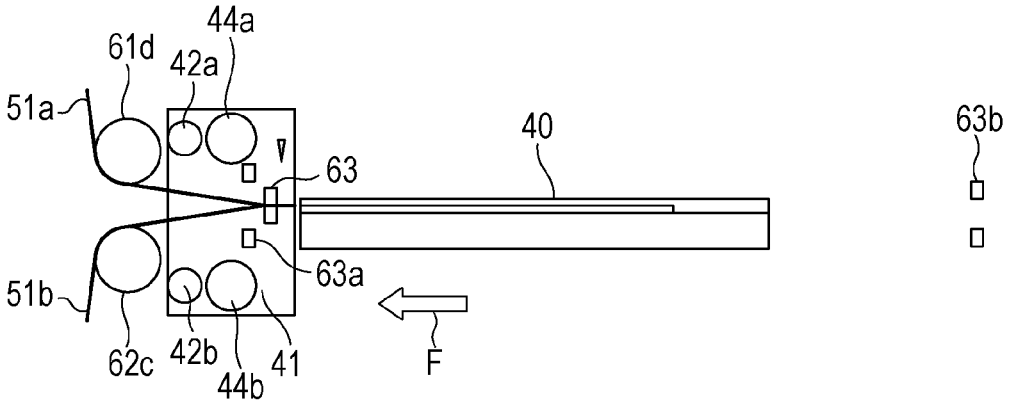

FIGS. 10A to 10C illustrate steps of cutting a sheet with the cutter (step S4 of FIG. 8). This operation is performed in the state shown in FIG. 9C.

In the initial state shown in FIG. 10A, the first chuck 63*a* clamps a first adhesive tape 51*a*, which is guided by the guide roller 61*d*, and a second adhesive tape 51*b*, which is guided by the guide roller 62*c*, so that the adhesive surfaces of the tapes 51*a* and 51*b* face each other. The processing unit 41 is at rest on a side opposite to a side from which the adhesive tapes are supplied. The processing unit 41 includes the upper round blade 42*a* and the lower round blade 42*b*, which correspond to a cutter. The upper round blade 42*a* and the lower round blade 42*b* can be moved by an actuator between a position at which the blades 42*a* and 42*b* are separated from each other and a position at which the blades 42*a* and 42*b* contact each other.

As illustrated in FIG. 10B, the processing unit 41 moves in the direction of arrow F when cutting a sheet. FIG. 10C illustrates a state in which the sheet has been cut. At this time, the processing unit 41 is at rest at a position on the side from which the adhesive tapes are supplied. After the sheet has been cut, the movable chuck 63, which is disposed in the processing unit 41, clamps ends of the adhesive tapes, and the first chuck 63*a* is withdrawn.

Figure 11A:
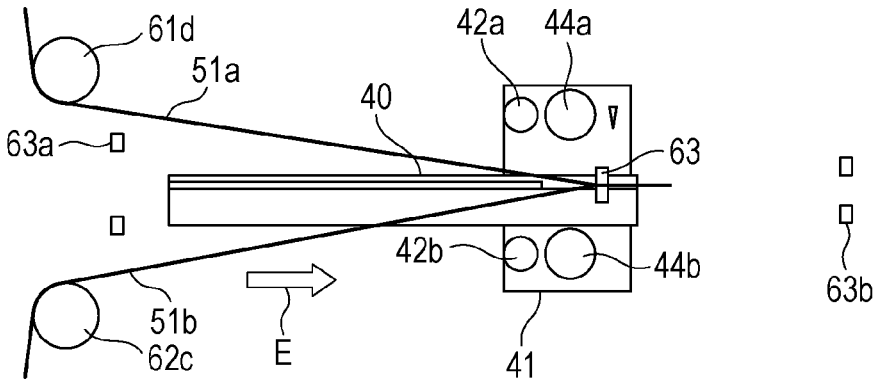
FIGS. 11A to 11C illustrate steps of supplying tapes.
Figure 11B:
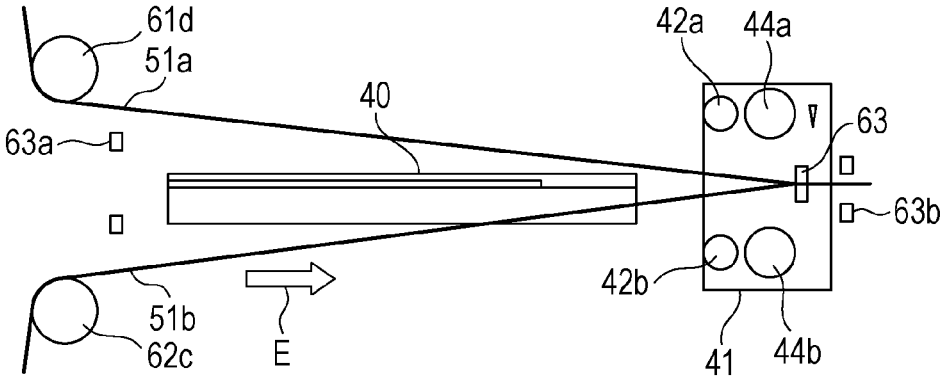
Figure 11C:
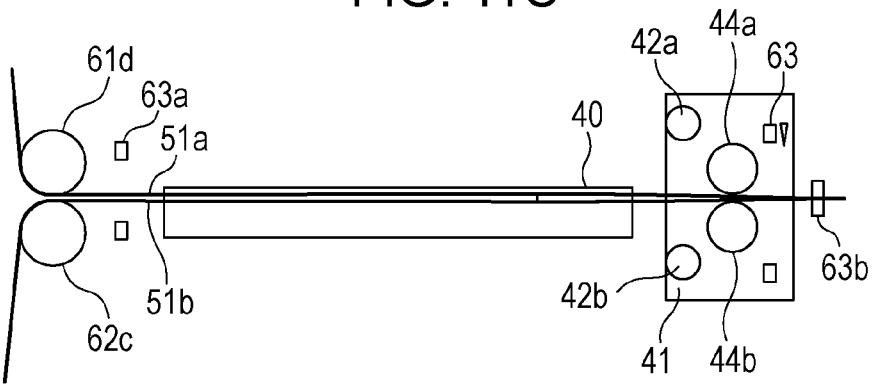

FIGS. 11A to 11C illustrate steps of supplying adhesive tapes to the processing stage with the taping unit (step S6 of FIG. 8). This operation is performed in the state shown in FIG. 9D.

FIG. 11A illustrates a state in which the processing unit 41 is moving in the direction of arrow E from the state shown in FIG. 10C. The first adhesive tape 51*a* and the second adhesive tape 51*b* are supported at three positions, that is, by the movable chuck 63, the guide roller 61*d*, and the guide roller 62*c*, so that a wedge-shaped gap having an acute angle is formed between the tapes 51*a* and 51*b*. In the initial state shown in FIG. 11A, the guide roller 61*d* is located at an upper position and the guide roller 62*c* is located at a lower position, and the first adhesive tape 51*a* and the second adhesive tape 51*b* are separated from each other by a large distance. Therefore, the acute angle of the wedge-shaped gap is large. The adhesive tapes, which are in such positions, pass through the large gap between the cut sheets shown in FIG. 9D. Therefore, the adhesive tapes do not contact the sheet. FIG. 11B illustrates a state in which the processing unit 41 has moved further and ends of the adhesive tapes have reached a position at which the second chuck 63*b* can clamps the ends of the adhesive tapes.

Next, as illustrated in FIG. 11C, the second chuck 63*b* clamps the ends of the adhesive tapes, and the movable chuck 63 is withdrawn. Next, the guide roller 61*d* is moved downward and the guide roller 62*c* is moved upward until the rollers 61*d* and 62*c* substantially contact each other. At this time, the first adhesive tape 51*a* is located above the gap between the image portion 50*a* and the binding margin portion 50*b* of the sheet and the second adhesive tape 51*b* is located below the gap between the image portion 50*a* and the binding margin portion 50*b* of the sheet. The acute angle of the wedge-shaped gap decreases. FIG. 9E shows this state. Then, the upper press-bonding roller 44*a* and the lower press-bonding roller 44*b*, which are disposed in the processing unit 41, are moved so as to nip the adhesive tapes therebetween.

Figure 12A:
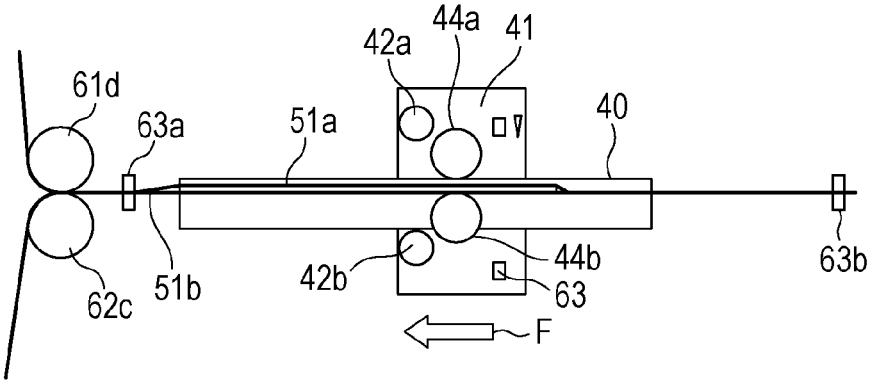
FIGS. 12A to 12C illustrate steps of affixing and cutting tapes.
Figure 12B:
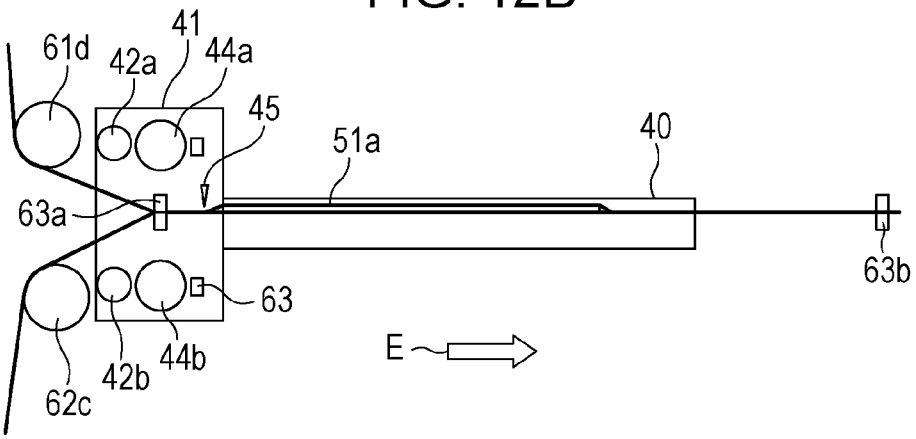
Figure 12C:
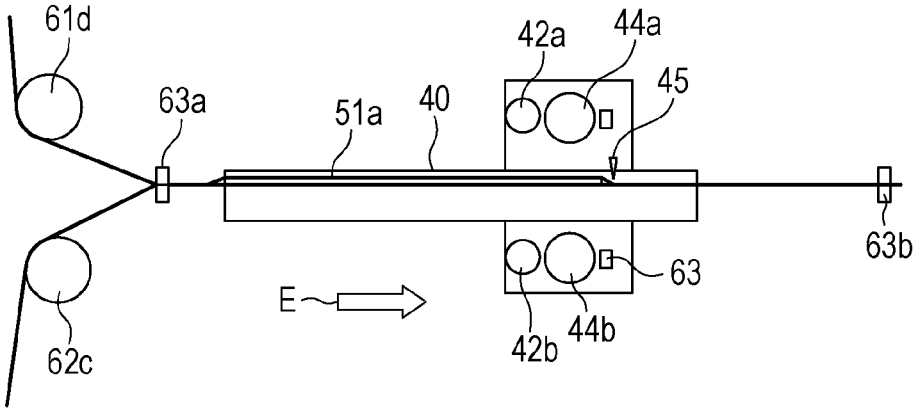

FIGS. 12A to 12C illustrate steps of affixing the adhesive tapes and cutting the adhesive tapes with the taping unit (steps S7 and S8 of FIG. 8). This operation is performed in the states shown in FIGS. 9E and 9F.

FIG. 12A illustrates a state in which the processing unit 41 is moving in the direction of arrow F. The upper press-bonding roller 44*a* and the lower press-bonding roller 44*b* roll along a sheet while nipping the sheet between the adhesive tapes. Accordingly, the adhesive tapes are strongly bonded to the sheet from both sides of the sheet. As illustrated in FIG. 12B, when the processing unit 41 has moved to an opposite end portion, the upper press-bonding roller 44*a* and the lower press-bonding roller 44*b* are separated from each other. A cutter 45 for cutting tapes, which is disposed in the processing unit 41, cuts one end of each adhesive tape. Next, as illustrated in FIG. 12C, the processing unit 41 is returned in the direction of arrow E, and cuts the other end of each adhesive tape (step S8 of FIG. 8).

FIGS. 13A to 13E are top views illustrating an operation of simultaneously supplying an unprocessed sheet and outputting a processed sheet, which is performed by the sheet transporter. By simultaneously performing a sheet-supplying operation and a sheet-outputting operation, the throughput of the apparatus is improved as compared with a case where these operations are performed serially.

Figure 13D:
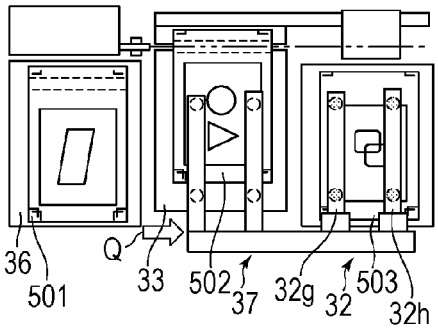
Figure 13B:
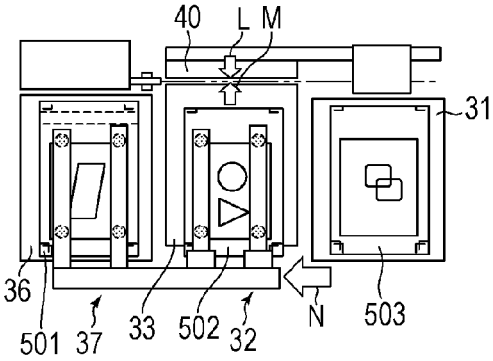

FIG. 13A illustrates a state in which a sheet 501 has been processed and the next unprocessed sheet 502 is being supplied. The suction pads of the feed arm 32 hold the sheet 502 by suction, and the suction pads of the output arm 37 hold the sheet 501 by suction. When the suction pads hold the sheets by suction, the supply tray 31 moves upward so that the uppermost sheet contacts the suction pads. When the two sheets 501 and 502 are held by suction, the feed arm 32 and the output arm 37 move upward. Next, as illustrated in FIG. 13B, the arms 32 and 37 move in the direction of arrow N, and the processed sheet 501 and the unprocessed sheet 502 are respectively transported to positions above the output tray 36 and the first stage 33. Then, the first stage 33 is moved in the direction of arrow M and the second stage 40 is moved in the direction of arrow L so that the distance between the stages 33 and 40 decreases. In this state, the sheets are not placed on the stages and the tray but are located above the stages and the tray.

Figure 13E:
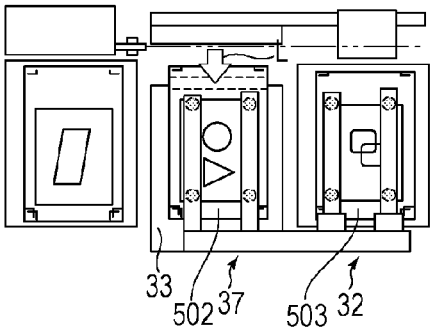
Figure 13C:
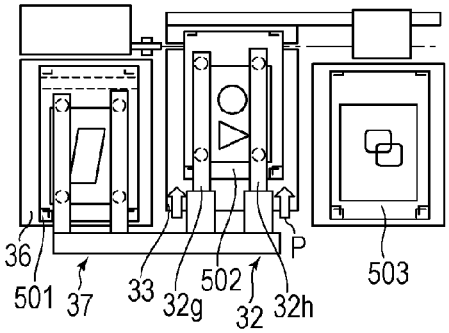

Next, as illustrated in FIG. 13C, two sub-arms 32*g* and 32*h* of the feed arm 32 are extended in the direction of arrow P by using an actuator so that a part of the unprocessed sheet 502 is positioned above the first stage 33 and the remaining part of the unprocessed sheet 502 is positioned above the second stage 40. The feed arm 32 and the output arm 37 are moved downward so that the processed sheet 501 is placed on the output tray 36 and the unprocessed sheet 502 is placed on the first stage 33 and the second stage 40. When the negative pressures of the suction pads are released to stop holding the sheets by suction, the feed arm 32 and the output arm 37 are moved upward, and the two sub-arms 32*g* and 32*h* of the feed arm 32 are contracted by using the actuator. Then, as illustrated in FIG. 13D, the feed arm 32 and the output arm 37 are moved in the direction of arrow Q and returned to their original positions.

Then, a process of positioning, cutting the sheet, forming a gap between the cut portions of the sheet, taping, and cutting tapes is performed on the sheet 502 placed on the processing table. After one process is finished, the next process is prepared by moving the supply tray 31 upward and holding the next unprocessed sheet 503 by suction with the suction pads of the feed arm 32. After the sheet 502 has been processed, as illustrated in FIG. 13E, the first stage 33 is moved in the direction of arrow L so that the processed sheet 502 is located under the output arm 37. This state is the same as that shown in FIG. 13A, and the same process is repeatedly performed thereafter.

Figure 14A:
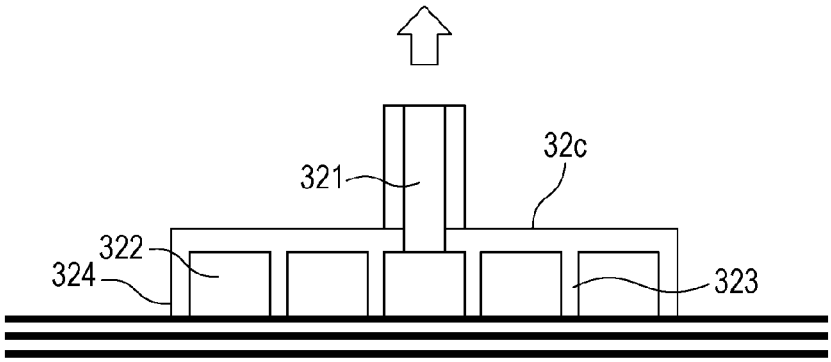
FIGS. 14A to 14C illustrate the structure of a suction pad.
Figure 14B:
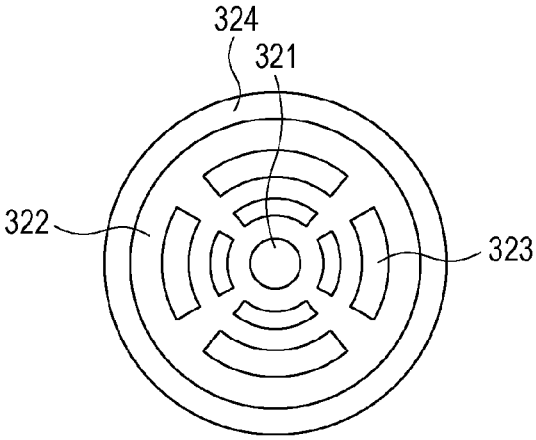
Figure 14C:
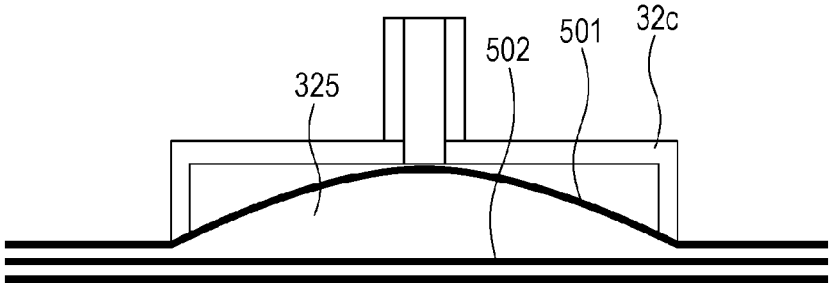

FIGS. 14A to 14C illustrate the structure of a suction pad (suction unit) of the feed arm 32. Here, the suction pad 32*c* is used as an example. Other suction pads each have the same structure. The suction pads of the output arm 37 each have the same structure.

The suction pad 32*c* includes a negative pressure chamber 322 formed by an outer peripheral wall 324, which has a cylindrical shape. As illustrated in FIGS. 14A and 14B, concentric ribs 323 having the same height as the outer peripheral wall are disposed in the negative pressure chamber 322. The negative pressure chamber 322, which is connected to a negative pressure source through a tube 321, holds a sheet by suction with a negative pressure supplied from the negative pressure source.

If the ribs 323 were not present, as illustrated in FIG. 14C, a part of the uppermost sheet 501 will be lifted inside the negative pressure chamber, and a space 325 having a negative pressure will be formed between the uppermost sheet 501 and the second sheet 502. Due to the presence of the space having a negative pressure, the second sheet 502 will be lifted together with the sheet 501, so that the sheet-separation performance will decrease. In contrast, when the concentric ribs 323 are present, ends of the ribs 323 contact and press the sheet, so that the second sheet is prevented from being lifted due to a negative pressure, and thereby a good sheet-separation performance is obtained. As described above, the suction unit includes concentric ribs formed in the outer peripheral wall, and an end of the outer peripheral wall and ends of the ribs contact a sheet when the suction unit holds the sheet by suction.

Figure 15A:
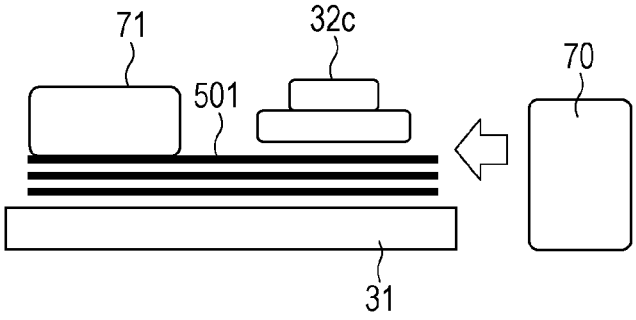
FIG. 15A to 15C illustrates a mechanism for increasing the performance of separating stacked sheets.
Figure 15B:
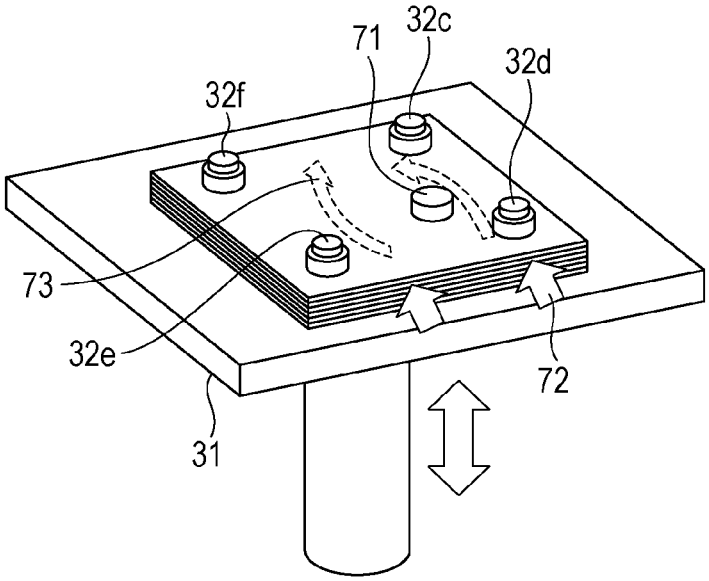
Figure 15C:
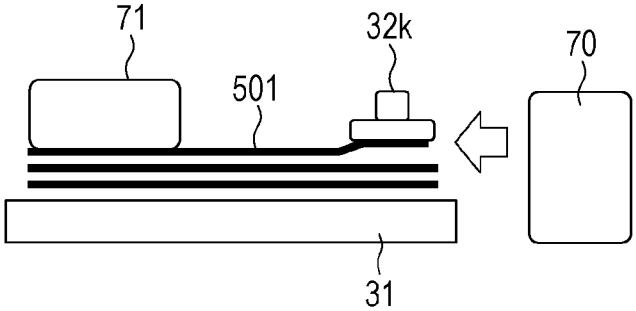
Figure 16A:
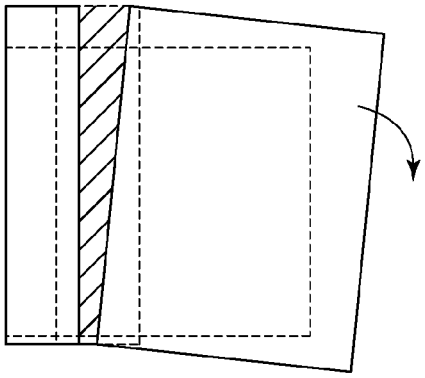
FIGS. 16A to 16C illustrate a problem of an existing technology.
Figure 16B:
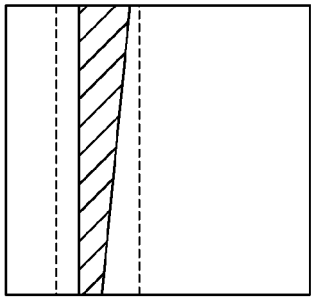
Figure 16C:
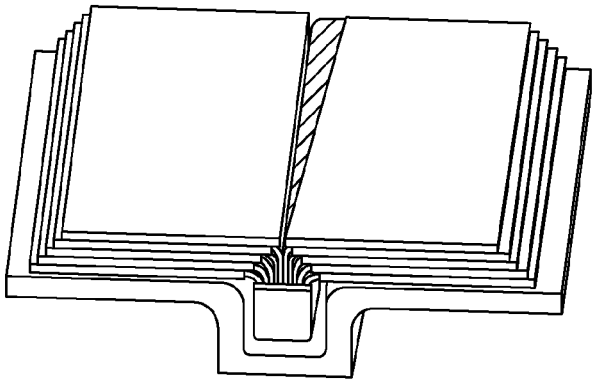

FIG. 15A illustrates the blower 70, which is included in the apparatus according to the present embodiment so as to further increase the performance of separating sheets stacked on the supply tray from each other. The blower 70 blows air from a side of sheets stacked on the supply tray 31 when picking up a sheet. The blower 70 accelerates separation of the first sheet 501 by moving air into a space between the first sheet 501 and the second sheet. As illustrated in FIG. 15B, because the first sheet 501 is in contact with a height-regulating member 71 for regulating the height of the stacked sheets, it is difficult to generate an air flow 73 between the first sheet 501 and the second sheet. Therefore, as illustrated in FIG. 15C, a dedicated suction pad 32*k* (suction unit) is provided to lift an end portion of the sheet 501 near the blower 70. Before the other suction pads 32*c*, 32*d*, 32*e*, and 32*f* lift the sheet 501, the suction pad 32*k* lifts the end portion of the sheet 501, and separation of the sheet 501 from the second sheet is accelerated by blowing air to the lifted end portion from a side.

The sheet processing apparatus according to the embodiment, which has been described above, has the following advantages.

(1) In contrast to a sheet processing method described in Japanese Patent Laid-Open No. 9-123636, which is performed manually, the apparatus can automatically process a sheet without using manual operations by an operator. Therefore, sheets can be processed uniformly so as to enable high-quality bookbinding, and the apparatus is suitable for making a booklet having a large number of pages or for producing a large number of booklets.

(2) Because a binding margin portion is made by cutting a single printed sheet having an image printed thereon, a binding margin suitable for any sheet having any size or thickness and made of any material can be obtained. With the method described in Japanese Patent Laid-Open No. 9-123636, in which a binding margin portion (small piece) is prepared independently from the image portion, it is necessary to prepare small pieces suitable for the sizes and the thicknesses of printed sheets. That is, as the number of types of sheets used for bookbinding increases, the number of types of small pieces increases. In practice, it is difficult to prepare a large number of types of small pieces. In summary, the present embodiment realizes high-quality bookbinding of a variety of sheets at low cost.

(3) Because a binding margin portion is made by cutting single printed sheet, a binding margin having any size can be obtained by simply changing a cutting position. For example, with the present embodiment, the size of a binding margin can be easily made to differ between sheets. This is suitable for a case described above with reference to FIG. 1C.

(4) The positioning member positions the sheet placed on the processing table so that an edge of a binding margin portion of a sheet extends in a direction in which the cutter cuts the sheet by pressing the edge in a direction perpendicular to the direction in which the cutter cuts the sheet. Usually, when binding sheets, the sheets are stacked so that edges of the sheets on the binding margin side are aligned. With the present embodiment, each of the sheets is positioned by using an edge of the sheet on one side that is used as a positional reference when stacking the sheets. Therefore, the sheets can be stacked with a higher accuracy, so that high-quality bookbinding is realized. In addition, because the edge of the sheet positioned by the positioning member is parallel to the direction in which the cutter cuts the sheet, the hinge does not become wedge-shaped and therefore high-quality bookbinding is realized.

(5) Because the positional relationship between the first stage and the second stage can be changed in a direction perpendicular to the direction in which the cutter cuts the sheet, the dimensions of a gap formed between cut sheet portions can be set freely. Therefore, for example, the size of the binding margin can be easily made to differ between sheets in a case described above with reference to FIG. 1C.

(6) The quality of the finished product made by binding sheets depends on the control of the dimensions of a gap between cut sheet portions and the parallelism between the edges of the gap. With the present embodiment, the suction units of the first stage and the second stage strongly hold a sheet by suction. Therefore, the sheet does not move or become displaced on the stage when the cutter cuts the sheet or when the stages are moved after the sheet has been cut. Therefore, adjustment of the distance between cut sheet portions, which is performed after cutting the sheet and before affixing the tapes, can be performed with high accuracy, and therefore the quality of a finished product is very high.

(7) Before the suction units of the first stage and the second stage hold a sheet on the stages by suction, a pressing plate of the sheet transporter presses the sheet and corrects curl of the sheet. Therefore, the sheet can be securely held by suction in a short time.

(8) The direction in which the sheet transporter transports a sheet from the feed tray to the processing table is the same as the direction in which the cutter cuts the sheet. The processing unit, having the cutter therein, moves in a region that does not overlap a space between the processing table and the supply tray or a space between the processing table and the output tray. Therefore, the footprint of the apparatus does not increase.

(9) Transportation of a sheet from the feed tray to the processing table and transportation of a sheet from the processing table to the output tray are simultaneously performed. The throughput and the productivity of the apparatus are higher than in a case where these operations are performed serially.

(10) A first tape and a second tape are affixed from both sides of cut sheet portions. The time required for processing one sheet is shorter and the throughput of the apparatus is higher than in a case where a tape is affixed to each side at a time.

(11) Each suction pad includes concentric ribs that are disposed in an outer peripheral wall having a cylindrical shape. The uppermost sheet does not enter the inside of the pad due to a negative pressure when the sheet is picked up. Therefore, the sheet can be picked up without fail.

(12) When picking up a sheet by using suction pads, air is blown from a side. Therefore, separation of the uppermost sheet from the second sheet can be accelerated.

While the present disclosure has been described with reference to exemplary embodiments, it is to be understood that the exemplary embodiments are not seen to be limiting. The scope of the following claims is to be accorded the broadest interpretation so as to encompass all such modifications and equivalent structures and functions.

This application claims the benefit of Japanese Patent Application No. 2013-082420, filed Apr. 10, 2013, which is hereby incorporated by reference herein in its entirety.

What is claimed is:

1. A sheet processing apparatus that processes a printed sheet for bookbinding, the sheet processing apparatus comprising:

a table on which a sheet is placed when processing the sheet;

a positioning member that positions the sheet placed on the table;

a cutter that cuts the sheet positioned by the positioning member into a binding margin portion and an image portion; and a taping unit that joins the binding margin portion and the image portion together with a tape in a state in which a gap is formed between the binding margin portion and the image portion, wherein the table includes a first stage that holds the image portion of the sheet by suction and a second stage that holds the binding margin portion of the sheet by suction, and a positional relationship between the first stage and the second stage with respect to a direction perpendicular to a direction in which the cutter cuts the sheet is variable.

2. The sheet processing apparatus according to claim 1, further comprising:

a tray on which a plurality of printed sheets are stacked; and a transporter that transports the sheets stacked on the tray one by one to the table.

3. The sheet processing apparatus according to claim 2, wherein the positioning member positions a sheet placed on the table so that an edge of the binding margin portion of the sheet extends in a direction in which the cutter cuts the sheet by pressing the edge in a direction perpendicular to the direction in which the cutter cuts the sheet.

4. The sheet processing apparatus according to claim 2, wherein a direction in which the transporter transports the sheet from the tray to the table is the same as the direction in which the cutter cuts the sheet.

5. The sheet processing apparatus according to claim 2, wherein the transporter is capable of simultaneously transporting a sheet from the tray to the table and transporting a processed sheet from the table to an output tray.

6. The sheet processing apparatus according to claim 2, wherein the transporter includes a suction unit that holds a sheet by suction with a negative pressure, wherein the suction unit includes an outer peripheral wall having a cylindrical shape, and a concentric rib formed in the outer peripheral wall, and wherein an end of the outer peripheral wall and an end of the concentric rib contact the sheet when the suction unit holds the sheet by suction.

7. The sheet processing apparatus according to claim 2, wherein the transporter includes a suction unit that holds a sheet by suction with a negative pressure and lifts the sheet, and wherein separation of the sheet is accelerated by blowing air from a side in a state in which an end portion of the sheet is lifted by suction by the suction unit.

8. The sheet processing apparatus according to claim 1, wherein the second stage moves closer to the first stage so that the positioning member positions a sheet, which has been placed on the table by the transporter, in a state in which the sheet is not held by any of the second stage and the first stage by suction, wherein the cutter cuts the sheet along a gap between the second stage and the first stage in a state in which the sheet is held by both of the second stage and the first stage by suction, and wherein the second stage is moved so that a predetermined gap is formed between the binding margin portion and the image portion of the sheet, and the taping unit joins the binding margin portion and the image portion together by affixing the tape over the gap between the binding margin portion and the image portion.

9. The sheet processing apparatus according to claim 1, further comprising:

a pressing plate that presses the sheet toward the table, wherein the pressing plate presses an end portion of the sheet, which has been placed on the table by the transporter, before the sheet is held by suction by the second stage and the first stage, and the pressing plate is withdrawn while the sheet is held by suction.

10. The sheet processing apparatus according to claim 1, wherein the taping unit affixes a first tape and a second tape to joint portions of the binding margin portion and the image portion of the sheet from both sides of the sheet.

11. The sheet processing apparatus according to claim 10, wherein the taping unit holds the first tape and the second tape so that an acute angle is formed between the first tape and the second tape with a sheet therebetween and decreases the acute angle when affixing the tapes.

12. The sheet processing apparatus according to claim 10, wherein the taping unit includes a press-bonding roller that rolls along a sheet while pressing the first and second tapes, which have been supplied to the taping unit, against the sheet.

13. The sheet processing apparatus according to claim 1, wherein the taping unit joins the binding margin portion and the image portion of the sheet together by affixing the tape in a state in which a gap is formed between the binding margin portion and the image portion, and wherein a dimension of the gap in a direction in which the binding margin portion and the image portion of the sheet are separated from each other is set in accordance with at least one of the number of sheets to be bound, a total thickness of the sheets that are stacked, and a thickness of one of the sheets.

14. A sheet processing apparatus that processes a printed sheet for bookbinding, the sheet processing apparatus comprising:

a table on which a sheet is placed when processing the sheet;

a positioning member that positions the sheet placed on the table;

a cutter that cuts the sheet positioned by the positioning member into a binding margin portion and an image portion;

a taping unit that joins the binding margin portion and the image portion together with a tape in a state in which a gap is formed between the binding margin portion and the image portion;

a tray on which a plurality of printed sheets are stacked; and a transporter that transports the sheets stacked on the tray one by one to the table, wherein the transporter includes a suction unit that holds a sheet by suction with a negative pressure, wherein the suction unit includes an outer peripheral wall having a cylindrical shape and a concentric rib formed in the outer peripheral wall, and wherein an end of the outer peripheral wall and an end of the concentric rib contact the sheet when the suction unit holds the sheet by suction.

* * * * *